US009849063B2

(12) United States Patent
Liao

(10) Patent No.: US 9,849,063 B2
(45) Date of Patent: Dec. 26, 2017

(54) FREQUENCY-VARIABLE GOLDEN BEAUTY BAR

(71) Applicant: SHENZHEN SIKEN3D DIGITIZING CO., LTD, Shenzhen (CN)

(72) Inventor: Zhisheng Liao, Shenzhen (CN)

(73) Assignee: SHENZHEN SIKEN3D DIGITIZING CO., LTD, Shenzhen (CN)

( * ) Notice: Subject to any disclaimer, the term of this patent is extended or adjusted under 35 U.S.C. 154(b) by 572 days.

(21) Appl. No.: 14/564,697

(22) Filed: Dec. 9, 2014

(65) Prior Publication Data

US 2016/0022535 A1 Jan. 28, 2016

(30) Foreign Application Priority Data

Jul. 24, 2014 (CN) ..... 2014 2 0411028 U

(51) Int. Cl.
*A61H 23/02* (2006.01)

(52) U.S. Cl.
CPC ..... *A61H 23/0254* (2013.01); *A61H 2201/50* (2013.01); *A61H 2201/5005* (2013.01)

(58) Field of Classification Search
CPC ..... A61H 23/0254
USPC ..... 318/503, 494
See application file for complete search history.

(56) References Cited

U.S. PATENT DOCUMENTS 6,801,013 B2 * 10/2004 Woodward ..... H02P 27/08 318/729
7,227,330 B2 * 6/2007 Swamy ..... H02P 3/18 187/296
7,336,052 B2 * 2/2008 Grbovic ..... H02M 5/458 318/400.3

* cited by examiner

*Primary Examiner* — David S Luo
(74) *Attorney, Agent, or Firm* — Anova Law Group, PLLC

(57) ABSTRACT

The present invention discloses a frequency-variable golden beauty bar, the frequency-variation golden beauty bar includes a beauty bar body, and a circuit board arranged in the said the beauty bar body, wherein, the circuit board includes: a control module, configured to convert a voltage variation into a frequency variation; an enable module, configured to receive a signal of the frequency variation and control a motor rotating speed; the control module connects to the enable module. The frequency-variable golden beauty bar as provided in the present invention, makes it possible to adjust an adjustable potentiometer through a knob on a tail part, and decide the voltage variation of the adjustable potentiometer through an MCU chip, then convert it into frequency variation, followed by controlling the vibration frequency of the motor through a high frequency MOS transistor, thus achieves the frequency variation of the beauty bar.

8 Claims, 2 Drawing Sheets

FREQUENCY-VARIABLE GOLDEN BEAUTY BAR

CROSS-REFERENCES TO RELATED APPLICATIONS

This application claims the priority of Chinese patent application no. 201420411028.X, filed on Jul. 24, 2014, the entire contents of all of which are incorporated herein by reference.

FIELD OF THE INVENTION

The present invention relates to the field of technologies on appliances in beauty area, and more particularly, to a frequency-variable golden beauty bar.

BACKGROUND

There are regular and balanced natural currents in human bodies at the beginning, however, following the accumulations of work pressure or the growth of age, irregular variations to the natural currents in human bodies could be induced, which is also the major culprit causing aging phenomena, such as the appearance of black spots in human skin, skin relaxation and more. Beauty bars are commonly used beauty appliances in our daily life, however, different people in different ages, different skins of different people, and even the same person in different seasons, the favorite vibration frequencies to their skins are different. However, beauty bars currently provided in the market are not frequency-variable, thus can't adapt to all human groups.

Therefore, the prior art needs to be improved and developed.

BRIEF SUMMARY OF THE DISCLOSURE

The technical problem to be solved in the present invention, aiming at the defects of the prior art, provides a frequency-variable golden beauty bar, in order to solve the problems in the prior art that the frequencies adopted in the beauty bars are non-variable.

The technical solution of the present invention to solve the said technical problems is as follows:

A frequency-variable golden beauty bar, the said frequency-variable golden beauty bar includes a beauty bar body and a circuit board, the said circuit board arranged in the said beauty bar body, wherein, the said circuit board includes:

A control module, configured to convert a voltage variation into a frequency variation;

An enable module, configured to receive a signal of the frequency variation then control a rotating speed of a motor;

The said control module connects to the said enable module.

The said frequency-variable golden beauty bar, wherein, the said control module comprises an MCU chip, a first resistor, a second resistor, a first capacitor and an adjustable potentiometer; a VDD terminal of the said MCU chip connects to a power source terminal through the first resistor, and gets grounded through the first capacitor, while a GP3/MCLR/VPP terminal of the said MCU chip connects to a second pin and a third pin of the adjustable potentiometer, whose first pin and fourth pin are grounded, and the second pin connects to the VDD terminal of the MCU chip through the second resistor, a GP2/TOCK1 terminal of the MCU chip connects to the said enable module, and a GND terminal of the MCU chip is grounded.

The said frequency-variable golden beauty bar, wherein, the said enable module comprises a first MOS transistor and a third resistor; a gate electrode of the said first MOS transistor connects to the GP2/TOCK1 terminal of the MCU chip, a source electrode of the said first MOS transistor connects to the power source terminal, while also connects to the GP2/TOCK1 terminal of the MCU chip through the third resistor, and a drain electrode of the first MOS transistor is an output terminal.

The said frequency-variable golden beauty bar, wherein, the said first capacitor is a filter capacitor.

The said frequency-variable golden beauty bar, wherein, a resistance value of the said first resistor is 5R.

The said frequency-variable golden beauty bar, wherein, the said second resistor is a divider resistor with the resistance value of 470 KΩ.

The said frequency-variable golden beauty bar, wherein, the said MCU chip is a kind of MCU chip with a model number of PIC12F508 or MDT10P53.

The said frequency-variable golden beauty bar, wherein, the said first MOS transistor is a PMOS transistor.

The said frequency-variable golden beauty bar, wherein, the said third resistor is a pull-up resistor with the resistance value of 4.7 KΩ.

Comparing to the prior art, the frequency-variable golden beauty bar, provided in the present invention, makes it possible to adjust the adjustable potentiometer through a knob on a tail part, and decide the voltage variation of the adjustable potentiometer through the MCU chip, then convert into frequency variation, followed by controlling the vibration frequency of the motor through a high frequency MOS transistor, thus achieves the frequency variation of the beauty bar.

DETAILED DESCRIPTION

The present invention provides a frequency-variable golden beauty bar, in order to make the purpose, technical solution and the advantages of the present invention clearer and more explicit, further detailed descriptions of the present invention are stated here, referencing to the attached drawings and some embodiments of the present invention. It should be understood that the detailed embodiments of the invention described here are used to explain the present invention only, instead of limiting the present invention.

Figure 1:
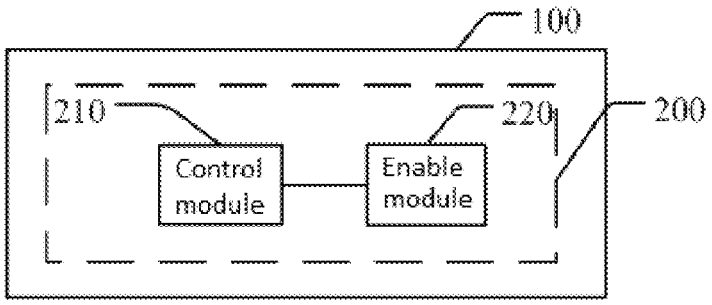
FIG. 1 illustrates a structure diagram of a frequency-variable golden beauty bar as described in the present invention.

Referencing to FIG. 1, which is a structure diagram of the said frequency-variable golden beauty bar as described in the present invention, wherein, it includes a beauty bar body 100 and a circuit board 200, the circuit board 200 arranged in the said beauty bar body. The said circuit board includes a control module 210 and an enable module 220, while the said control module 210 connects to the said enable module 220.

Wherein, the said control module 210 is configured to convert the voltage variation into frequency variation, and the said enable module 220 is configured to receive a signal of the frequency variation and control a rotating speed of a motor.

Figure 2:
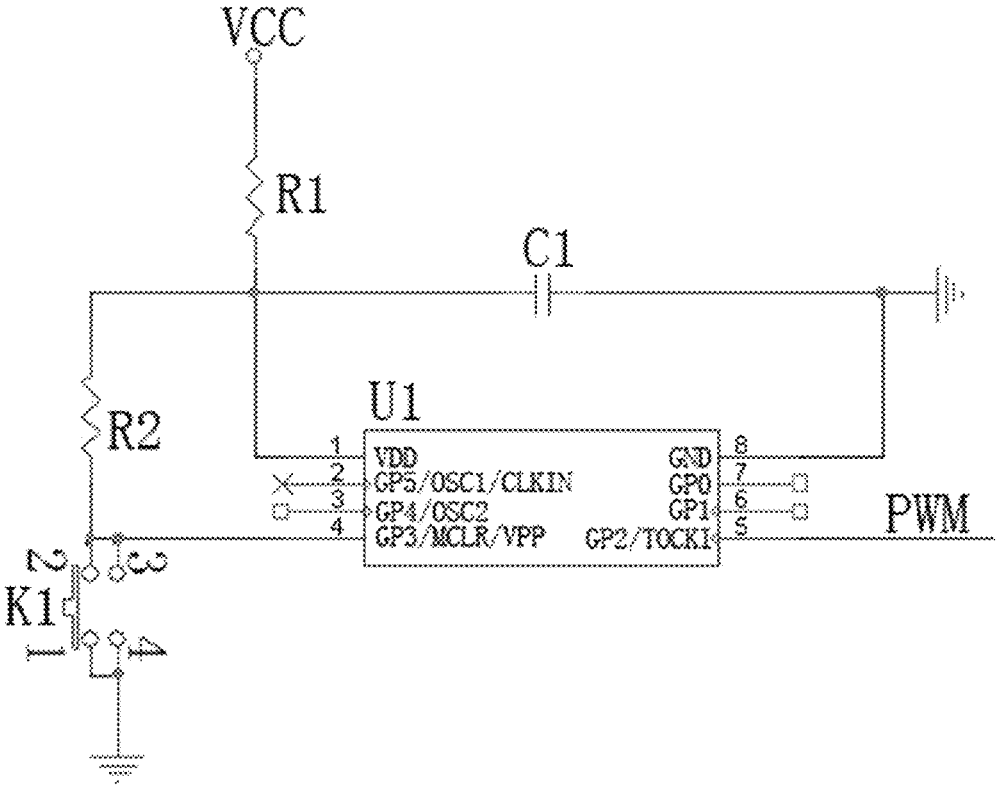
FIG. 2 illustrates a circuit diagram of a control module in the said frequency-variable golden beauty bar as described in the present invention.

Also referencing to FIG. 2, which is a circuit diagram of the control module in the said frequency-variable golden beauty bar as described in the present invention. In a specific implementation process, the said control module 210 comprises an MCU chip U1, a first resistor R1, a second resistor R2, a first capacitor C1 and an adjustable potentiometer K1; a VDD terminal of the said MCU chip U1 connects to a power source terminal VCC through the first resistor R1, and gets grounded through the first capacitor C1, while a GP3/MCLR/VPP terminal of the said MCU chip U1 connects to a second pin and a third pin of the adjustable potentiometer K1, whose first pin and fourth pin are grounded, and the second pin also connects to the VDD terminal of the MCU chip U1 through the second resistor R2. While a GP2/TOCK1 terminal of the MCU chip U1 connects to the said enable module 220, and a GND terminal of the MCU chip U1 is grounded. In the specific implementation, the said MCU chip is a kind of MCU chip with a model number of PIC12F508 or MDT10P53, and the adjustable potentiometer K1 is a kind of potentiometer with a model number of TD-24EA.

In details, the power source terminal provides a work voltage of 3V. When the said control module 210 connects to the 3V work power, a resistance variation of the adjustable potentiometer K1 is detected by the GP3/MCLR/VPP terminal of the MCU chip U1, followed by adjusting a frequency of PWM (Pulse Width Modulation) based on the resistance variation of the adjustable potentiometer K1, thus the frequency variation is achieved. In the present invention, the range of the rotating speed of the motor is 0-7500 r/min.

Wherein, the first resistor R1 and the first capacitor C1 are filter circuits for the power source terminal, which are able to lower error effects of sharp peaks produced by a power source to the MCU chip U1. Preferably, a resistance value of the said first resistor R1 is 5R, the capacitance value of the said first capacitor C1 is 1 micro farad (1 μF).

The second resistor R2 is a divider resistor, which is able to take part of a voltage acting on the adjustable potentiometer K1, and makes the voltage acting on two ends of the potentiometer K1 is within the range of rated voltage. Preferably, the resistance value of the said resistor R2 is 470 KΩ.

Figure 3:
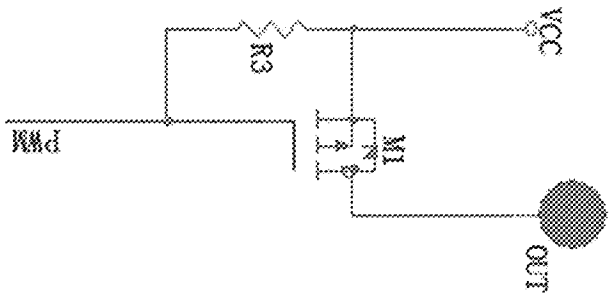
FIG. 3 illustrates a circuit diagram of an enable module in the said frequency-variable golden beauty bar as described in the present invention.

Referencing to FIG. 3, which is a circuit diagram of the enable module in the said frequency-variable golden beauty bar as described in the present invention. During the specific implementation, the said enable module 220 comprises a first MOS transistor M1 and a third resistor R3; a gate electrode of the said first MOS transistor M1 connects to the GP2/TOCK1 terminal of the MCU chip U1, and a source electrode of the first MOS transistor M1 connects to the power source terminal VCC, while also connects to the GP2/TOCK1 terminal of the MCU chip U1 through the third resistor R3, and a drain electrode of the first MOS transistor M1 is an output terminal OUT.

In the specific implementation, the said first MOS transistor M1 is a PMOS transistor with a model number of A03401, mainly acting as a switch. When a controlling signal inputs into the gate electrode of the first MOS transistor M1 is in a low electrical level, the first MOS transistor M1 will be turned on, and make the motor connecting to the drain electrode M1 start to work; when a controlling signal inputs into the gate electrode of the first MOS transistor M1 is in a high electrical level, the first MOS transistor M1 will be turned off, and will not affect the inputting electrical level to the power source terminal any more.

In summary, the present invention discloses a frequency-variable golden beauty bar, the said frequency-variable golden beauty bar includes a beauty bar body and a circuit board. the circuit board arranged in the said beauty bar body, wherein, the said circuit board includes: a control module, configured to convert a voltage variation into a frequency variation; an enable module, configured to receive a signal of the frequency variation and control a rotating speed of a motor; the said control module connects to the said enable module. The said frequency-variable golden beauty bar as provided in the present invention, makes it possible to adjust an adjustable potentiometer through a knob on a tail part, and decide the voltage variation of the adjustable potentiometer through an MCU chip, then convert it into frequency variation, followed by controlling a vibration frequency of the motor through a high frequency MOS transistor, thus achieves the frequency variation of the beauty bar.

It should be understood that, the application of the present invention is not limited to the above examples listed. It will be possible for a person skilled in the art to make modifications or replacements according to the above descriptions, which shall all fall within the protection scope of the appended claims of the present invention.

What is claimed is:

1. A frequency-variable golden beauty bar comprising a beauty bar body and a circuit board, the circuit board arranged in the beauty bar body, wherein the circuit board includes:

a control module, configured to convert a voltage variation into a frequency variation, comprising:

an MCU chip, a first resistor, a second resistor, a first capacitor and an adjustable potentiometer; wherein a VDD terminal of the MCU chip connects to a power source terminal through the first resistor, and gets grounded through the first capacitor, while a GP3/MCLR/VPP terminal of the MCU chip connects to a second pin and a third pin of the adjustable potentiometer, whose first pin and fourth pin are grounded, and the second pin connects to the VDD terminal of the MCU chip through the second resistor, a GP2/TOCK1 terminal of the MCU chip connects to the said enable module, and a GND terminal of the MCU chip is grounded; and an enable module, configured to receive a signal of the frequency variation and control a rotating speed of a motor, wherein the control module connects to the enable module.

2. The frequency-variable golden beauty bar according to claim 1, wherein, the enable module comprises a first MOS transistor and a third resistor; a gate electrode of the first MOS transistor connects to the GP2/TOCK1 terminal of the MCU chip, a source electrode of the first MOS transistor connects to the power source terminal, while also connects to the GP2/TOCK1 terminal of the MCU chip through the third resistor, and a drain electrode of the first MOS transistor is an output terminal.

3. The frequency-variable golden beauty bar according to claim 2, wherein, the first MOS transistor is a PMOS transistor.

4. The frequency-variable golden beauty bar according to claim 2, wherein, the third resistor is a pull-up resistor with the resistance value of 4.7 KΩ.

5. The frequency-variable golden beauty bar according to claim 1, wherein, the first capacitor is a filter capacitor.

6. The frequency-variable golden beauty bar according to claim 1, wherein, a resistance value of the first resistor is 5R.

7. The frequency-variable golden beauty bar according to claim 1, wherein, the second resistor is a divider resistor with the resistance value of 470 KΩ.

8. The frequency-variable golden beauty bar according to claim 1, wherein, the MCU chip is a MCU chip with a model number of PIC12F508 or MDT10P53.

* * * * *